US008869997B2

(12) United States Patent
Collini

(10) Patent No.: US 8,869,997 B2
(45) Date of Patent: Oct. 28, 2014

(54) STORAGE APPARATUS FOR CONTAINERS

(76) Inventor: Lothar Collini, Klaus (AT)

( * ) Notice: Subject to any disclaimer, the term of this patent is extended or adjusted under 35 U.S.C. 154(b) by 763 days.

(21) Appl. No.: 13/129,992

(22) PCT Filed: Nov. 13, 2009

(86) PCT No.: PCT/AT2009/000434

§ 371 (c)(1),
(2), (4) Date: Sep. 8, 2011

(87) PCT Pub. No.: WO2010/057234

PCT Pub. Date: May 27, 2010

(65) Prior Publication Data

US 2011/0309220 A1 Dec. 22, 2011

(30) Foreign Application Priority Data

Nov. 18, 2008 (AT) ..... 1785/2008

(51) Int. Cl.
*A47B 73/00* (2006.01)
*A47F 7/28* (2006.01)
*A47F 5/08* (2006.01)

(52) U.S. Cl.
CPC . *A47B 73/00* (2013.01); *A47F 7/28* (2013.01); *A47F 5/0838* (2013.01)
USPC ..... 211/74; 248/105; 248/312

(58) Field of Classification Search
CPC ..... A47F 5/0838; A47B 73/00; A47B 7/28
USPC ..... 211/71.01, 74, 75, 76, 89.01; 206/503; D7/704; 248/102, 105, 146, 312
See application file for complete search history.

(56) References Cited

U.S. PATENT DOCUMENTS

| | | | | |
|---|---|---|---|---|
| 4,050,584 | A * | 9/1977 | Lino | 211/76 |
| 4,844,266 | A | 7/1989 | Small et al. | |
| 5,031,783 | A * | 7/1991 | Goudreau | 211/181.1 |
| 5,284,257 | A | 2/1994 | Schum | |
| 5,425,461 | A | 6/1995 | Larson | |
| 6,276,538 | B1 * | 8/2001 | Battaglia et al. | 211/59.2 |
| 7,669,723 | B2 * | 3/2010 | Kao | 211/70.6 |
| 7,806,278 | B2 * | 10/2010 | Brida | 211/74 |
| 2001/0045403 | A1 * | 11/2001 | Robertson | 211/59.2 |
| 2004/0104187 | A1 | 6/2004 | McCain | |
| 2013/0119004 | A1 * | 5/2013 | Lange | 211/74 |
| 2013/0233814 | A1 * | 9/2013 | Gupta | 211/74 |

FOREIGN PATENT DOCUMENTS

| | | | |
|---|---|---|---|
| CH | 357963 | A | 10/1961 |
| DE | 43 28 660 | | 3/1995 |
| EP | 0 271 651 | A2 | 6/1988 |
| EP | 0 323 751 | A2 | 7/1989 |
| NR | 357 963 | | 12/1961 |
| WO | WO 2008/028204 | | 3/2008 |

* cited by examiner

*Primary Examiner* — Gwendolyn W Baxter
(74) *Attorney, Agent, or Firm* — Cozen O'Connor

(57) ABSTRACT

A storage apparatus for containers, which have a diameter at one end which is different from the diameter at the other end, comprising supports for two rests, projecting from said supports, for containers positioned side by side transverse to the removal direction, one rest supporting one side of the container and the other rest supporting the other side, the supports of the rests being mounted adjustably relative to one another on a mounting. The rests are mounted at different heights from one another on the supports thereof for oblique storage of the containers transverse to the removal direction. A substantially rod-shaped lateral prop for propping up the container bases extends parallel to the associated rest and away from the rest support propping up the container end having the larger diameter.

8 Claims, 5 Drawing Sheets

STORAGE APPARATUS FOR CONTAINERS

RELATED APPLICATION

This is a U.S. national stage of application No. PCT/AT2009/000434, filed on Nov. 13, 2009.

This application claims the priority of Austrian Patent application no. A1785/2008, filed Nov. 18, 2008, the entire subject matter of which is hereby incorporated by reference.

FIELD OF THE INVENTION

The invention relates to a storage apparatus for containers, which have a diameter at one end which is different from the diameter at the other end, comprising supports for two rests, projecting from said supports, for containers positioned side by side transverse to the removal direction, one rest supporting one side of the container and the other rest supporting the other side, the supports of the rests being mounted adjustably relative to one another on a mounting.

BACKGROUND OF THE INVENTION

EP 0 271 651 A2 discloses a storage apparatus for containers which comprises a supporting frame with a plurality of supporting arms which can be suspended in a guide rail by guide shoes. Packages can be positioned between the webs of the supporting arms.

SUMMARY OF THE INVENTION

One object of the invention is to improve a storage apparatus of the type specified at the outset further, in such a way that it can be adapted to different sizes and types of containers, having different end diameters, with simple loading and removal. The storage apparatus according to the invention is distinguished in that the rests are mounted at different heights from one another on the supports thereof for oblique storage of the containers transverse to the removal direction, and in that a substantially rod-shaped lateral prop for propping up the container bases extends parallel to the associated rest and away from the rest support propping up the container end having the larger diameter.

In this manner, the construction, which consists for example of metal, plastics material or other materials, can be taken apart or put together and fixed so as be adapted to the respective container size or to the space available, for example in a cabinet or the like, for accommodating the storage device. The invention is adapted to all types of containers, but is particularly well adapted to storing bottles, for example in a bottle storage cabinet.

The rests are preferably in the form of toothed racks, as is known per se, so as to act to prevent rolling. According to a further feature of the invention, the supports comprise a plurality of parallel rests distributed over the height thereof, lateral props being respectively associated with the rest supports propping up the container end having the larger diameter.

One constructionally simple solution is distinguished in that the mounting is provided with spaced holes for receiving anchoring pins or the like which pass through the rest supports.

In a preferred embodiment, two rests for the large-diameter container end, which areadjustable horizontally relative to one another and relative to the rest for the small-diameter container end, are mounted mirror-symmetrically on the mounting by their supports.

Expediently, the rests and the prop extend away from the supports thereof with an upward inclination, as is known per se.

DETAILED DESCRIPTION OF THE DRAWINGS

Figure 2:
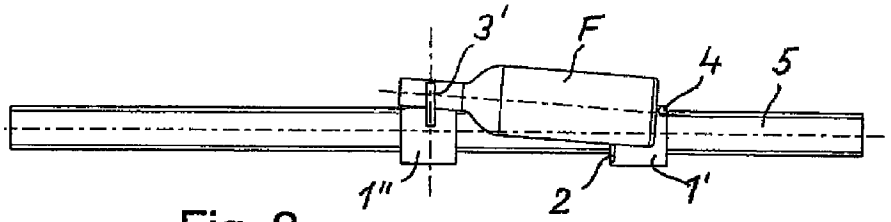
FIG. 2 is a front view of the storage apparatus.
Figure 3:
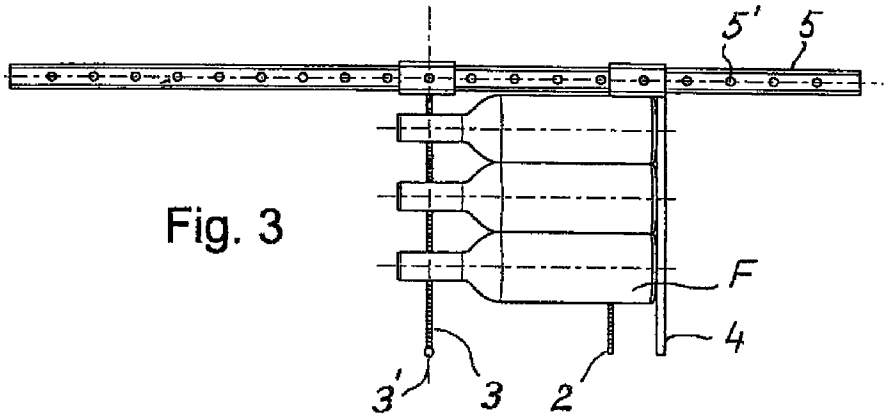
FIG. 3 is a plan view of the storage apparatus.
Figure 1:
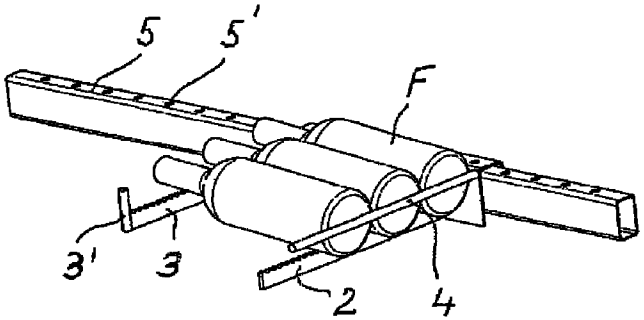
FIG. 1 is a schematic perspective view of a storage apparatus for bottles according to an embodiment of the invention.
Figure 4:
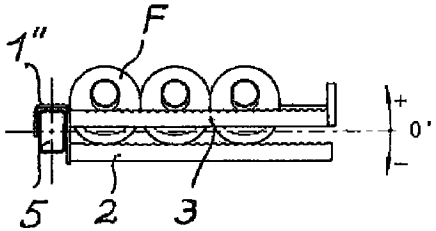
FIG. 4 is a side view from the left in FIG. 3.
Figure 6:
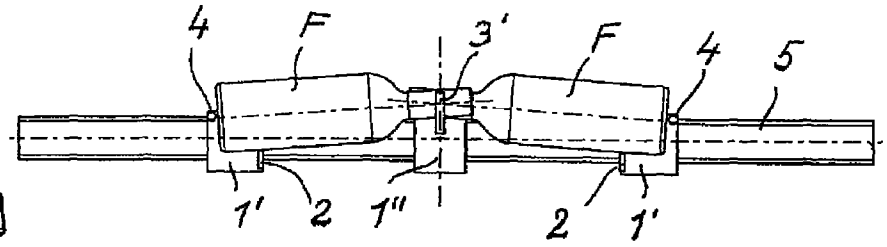
FIG. 6 is a front view of a modified embodiment of the storage apparatus.
Figure 7:
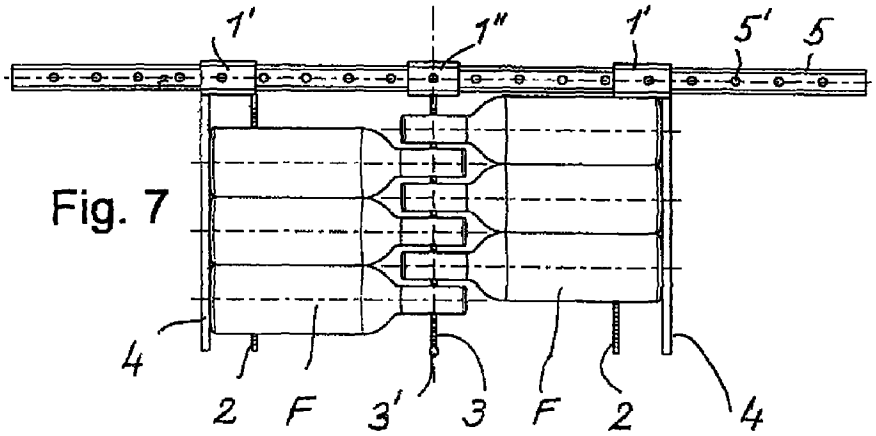
FIG. 7 is a plan view of the apparatus of FIG. 5.
Figure 5:
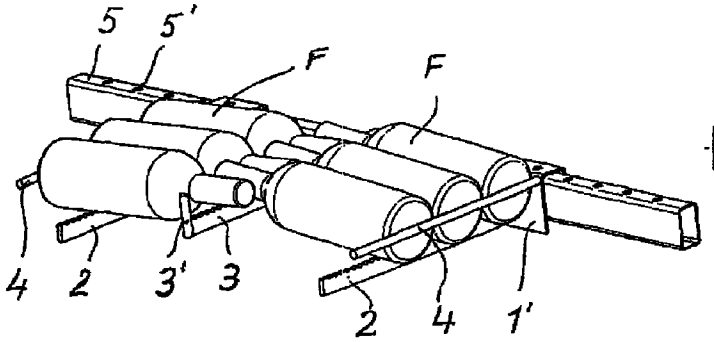
FIG. 5 is a perspective view of a development of the invention.
Figure 8:
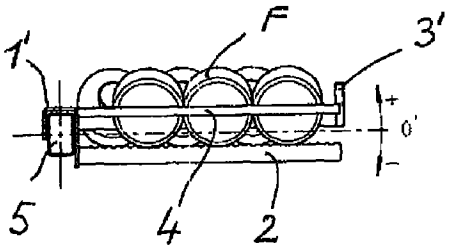
FIG. 8 is a side view from the left in FIG. 7.

The storage apparatus shown in FIGS. 1 to 4 comprises supports 1', 1" for two rests 2, 3, projecting therefrom and preferably formed as planar members, for bottles F which are positioned transverse to the removal direction, on which rests the bottles rest side by side via the bodies or necks thereof. The supports 1', 1" are hook-shaped form and are positioned adjustably on a transverse support 5, which is provided with a series of holes 5' into which pins (not shown) or the like passing through the supports 1', 1" can be inserted to fix the supports in the selected position in accordance with the bottle size. The rest 3 is provided with a stopper 3' at the free end thereof.

A lateral prop 4 for the base of the bottle extends parallel to the associated rest 2 and away from the rest support 1' propping up the body of the bottle.

The rests 2, 3 are expediently formed with teeth so as to store the bottles in a manner which prevents rolling. The rests may of course also be formed with a coating which prevents rolling and with any desired cross-section.

According to FIGS. 5 to 8, two rests 2, which are adjustable relative to one another and relative to the rest 3 which props up the bottle neck, are mounted mirror-symmetrically about said rest on the transverse support 5 by their supports 1', 1".

Figure 10:
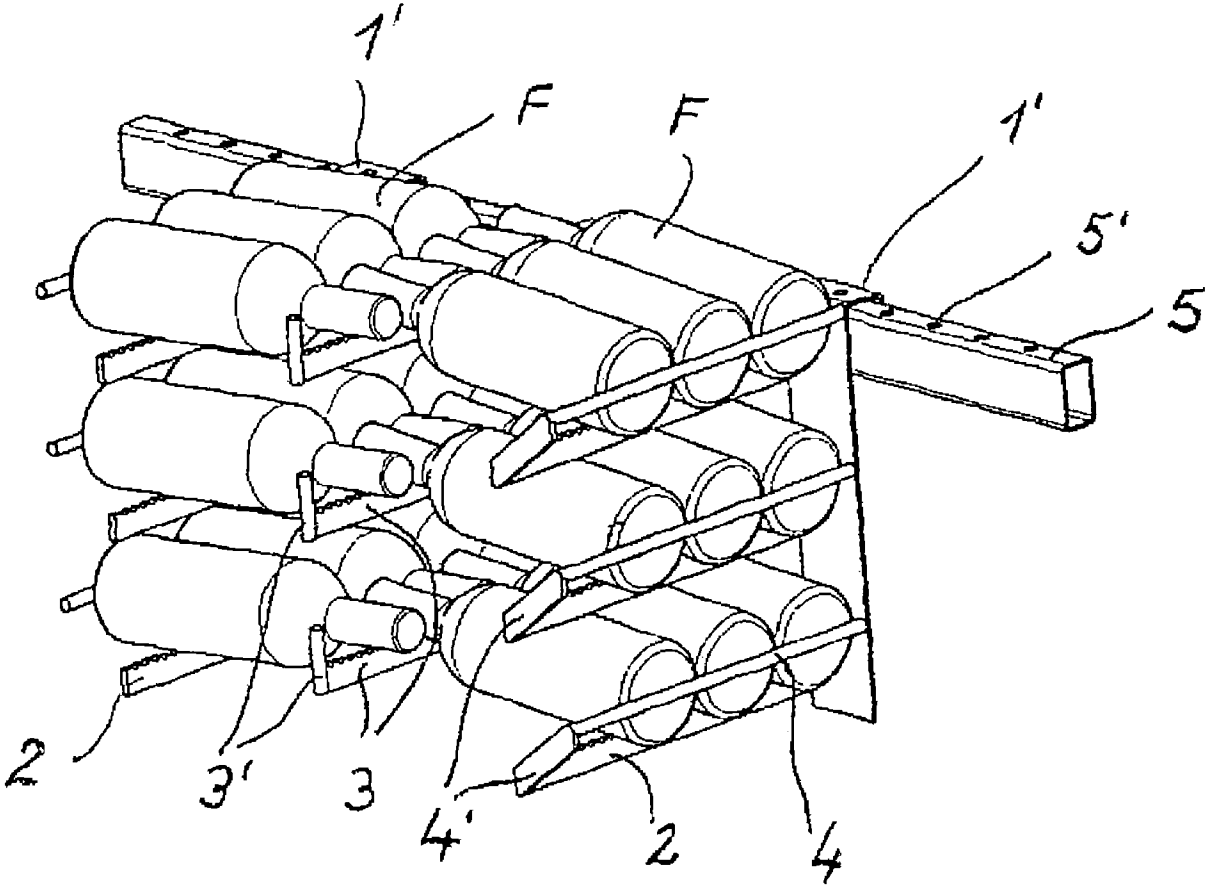
FIGS. 10 and 11 are perspective views of further embodiments of the invention.
Figure 11:
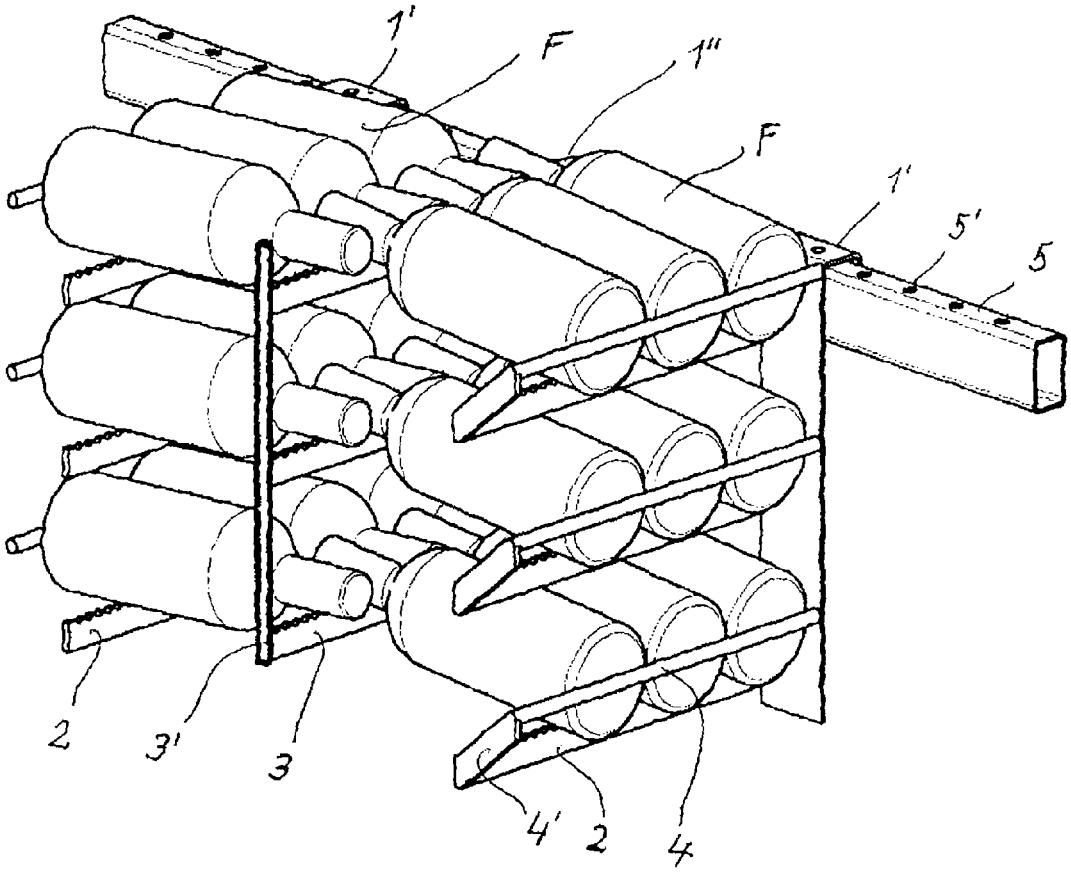

According to FIG. 10, the supports 1', 1" can be provided over the height thereof with a plurality of rests 2 arranged mirror-symmetrically about the bottle neck rests 3, it being possible for these bottle body rests 2 and the bottle base props 4 additionally to be connected at the front free ends thereof by a stopper 4', as is shown on the right in FIG. 10. In the example shown in FIG. 11, all of the bottle neck rests 3 are connected at the free end thereof to a continuous stopper 3".

Figure 9:
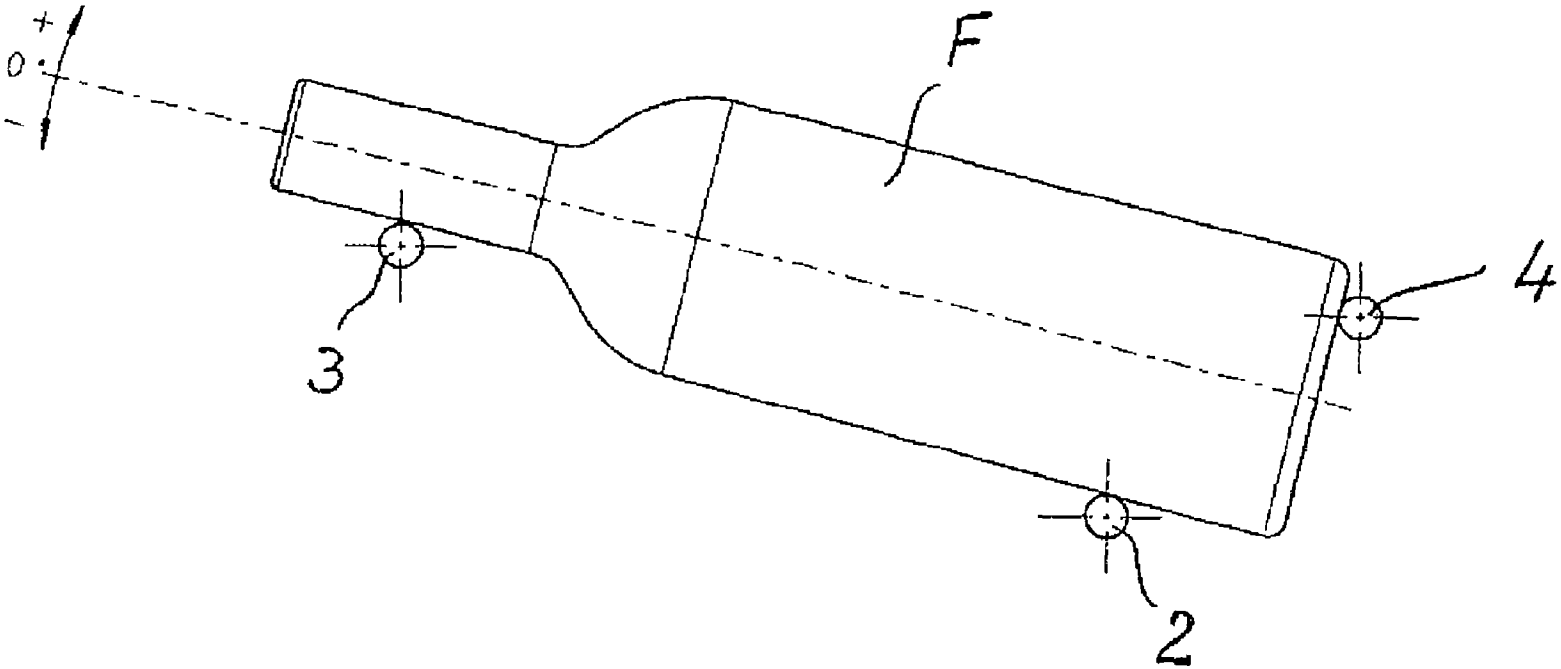
FIG. 9 shows in detail how the bottles are stored.

FIG. 9 shows schematically that the rests 2, 3, which in this case have a circular cross-section, and the bottle base prop 4 are offset from one another in height in such a way that the bottle F can be mounted at predetermined different angles. The rests may also be inclined towards the supports 1', 1" thereof or forwards away therefrom.

It will be appreciated that the present invention is not restricted to the embodiments shown and described above, but can be modified in various ways within the scope of protection of the claims, especially as regards the construction of the rests and the fixing of the rest supports to the transverse support, which may for example be fixable to a wall or to vertical connectors.

The invention claimed is:

1. A storage apparatus for containers, which have a diameter at one end which is different from the diameter at the other end, comprising supports for two rests, projecting from said supports, for containers positioned side by side transverse to a removal direction, one rest supporting one side of the container and the other rest supporting the other side, the supports of the rests being mounted adjustably relative to one another on a mounting, wherein the rests are mounted at different heights from one another on the supports thereof for oblique storage of the containers transverse to the removal direction, and wherein a substantially rod-shaped lateral prop for propping up the container bases extends parallel to the associated rest and away from the rest support propping up the container end having the larger diameter.

2. The apparatus according to claim 1, wherein the rests are in the form of toothed racks.

3. The apparatus according to claim 1, wherein the supports comprise a plurality of parallel rests distributed over the height thereof, lateral props being respectively associated with the rest supports propping up the container end having the larger diameter.

4. The apparatus according to claim 1, wherein the mounting is provided with spaced holes for receiving anchoring pins which pass through the rest supports.

5. The apparatus according to claim 1, wherein two rests for the large-diameter container end, which are adjustable horizontally relative to one another and relative to the rest for the small-diameter container end, are mounted mirror-symmetrically on the mounting by their supports.

6. The apparatus according to claim 1, wherein the rests and the prop extend away from the supports thereof with an upward inclination.

7. The apparatus according to claim 1, wherein the rests for the container end having the larger diameter are provided at their front end with a stopper, which in the case of a plurality of parallel rests is formed continuously.

8. The apparatus according to claim 7, wherein the free ends of the rests for the container end having the smaller diameter are connected to the associated prop by a stopper.

* * * * *